US007231790B2

(12) United States Patent
Tonelli

(10) Patent No.: US 7,231,790 B2
(45) Date of Patent: Jun. 19, 2007

(54) PADLOCK-TYPE LOCK FOR SUITCASES, TRUNKS AND THE LIKE

(75) Inventor: Massimo Tonelli, Casalecchio di Reno (IT)

(73) Assignee: GT Line S.R.L., Crespellano (IT)

( * ) Notice: Subject to any disclaimer, the term of this patent is extended or adjusted under 35 U.S.C. 154(b) by 0 days.

(21) Appl. No.: 11/042,072

(22) Filed: Jan. 26, 2005

(65) Prior Publication Data

US 2005/0172681 A1 Aug. 11, 2005

(30) Foreign Application Priority Data

Jan. 26, 2004 (IT) ..... BO20040005 U

(51) Int. Cl.
*E05B 67/36* (2006.01)

(52) U.S. Cl. ..... 70/33; 70/63; 190/101

(58) Field of Classification Search ..... 70/32–34, 70/63, 69, 71, 72, 158–169, 232; 190/119–121, 190/101

See application file for complete search history.

(56) References Cited

U.S. PATENT DOCUMENTS 1,454,546 A * 5/1923 Landis ..... 190/101
1,799,593 A * 4/1931 Lavender ..... 70/260
1,835,317 A * 12/1931 Miller ..... 70/33
2,999,377 A * 9/1961 Raye ..... 70/32
3,726,115 A * 4/1973 Wellekens ..... 70/33
3,901,058 A * 8/1975 Best ..... 70/32
3,996,774 A * 12/1976 Best ..... 70/32
4,229,955 A * 10/1980 Coralli et al. ..... 70/32
5,350,150 A * 9/1994 Fiore ..... 248/552
5,941,102 A * 8/1999 Reinholdsson et al. ..... 70/2
6,464,269 B1 * 10/2002 Wilhelm et al. ..... 292/307 R
6,604,390 B1 * 8/2003 Nooner ..... 70/63
2004/0154359 A1 * 8/2004 Jakubowski ..... 70/63
2004/0221626 A1 * 11/2004 Palzkill et al. ..... 70/34

* cited by examiner

*Primary Examiner*—Suzanne Dino Barrett
(74) *Attorney, Agent, or Firm*—Modiano & Associati; Albert Josif; Daniel O'Byrne

(57) ABSTRACT

A padlock-type lock for suitcases and us of the type constituted by a first half-shell and a second half-shell which are mutually articulated, comprising at least one padlock in which the locking bar is engaged, in a closed configuration, in a first through hole and in a second through hole, which are coaxial and are provided respectively in the first edge and in the second edge of the first half-shell and the second half-shells the padlock forming surfaces for mating with the first first edge and with the second edge, so that in the closed configuration the padlock is retained in a preset safe and minimum-protrusion position.

9 Claims, 2 Drawing Sheets

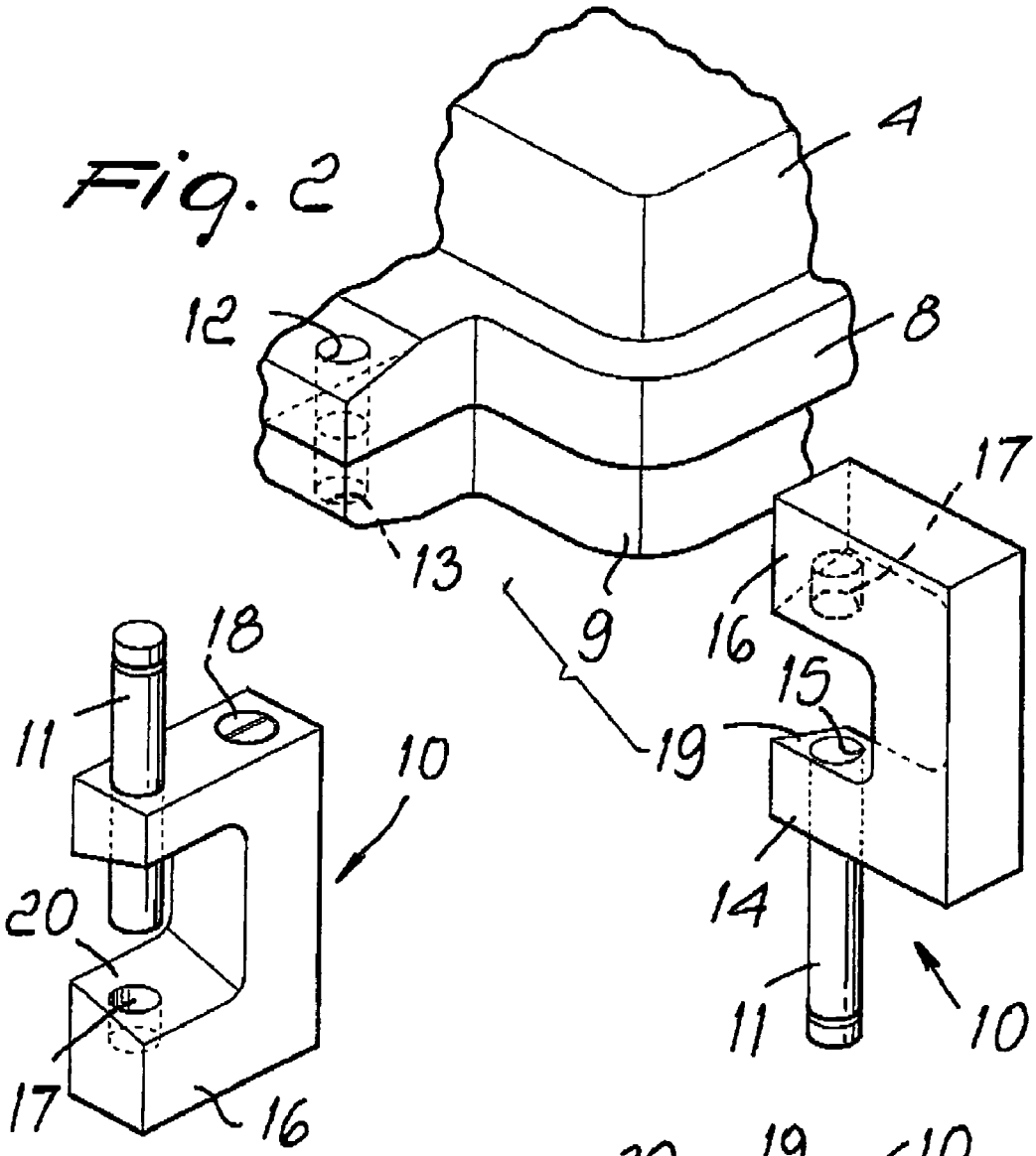
Fig. 2
Fig. 3
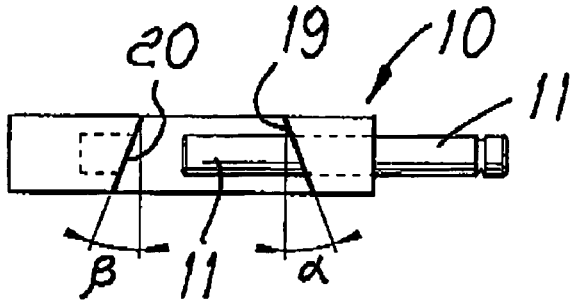
Fig. 4

PADLOCK-TYPE LOCK FOR SUITCASES, TRUNKS AND THE LIKE

BACKGROUND OF THE INVENTION

Many commercially available suitcases and trunks, for example those intended for professional uses, have locks provided with at least one padlock of the key-operated, combination or other type, in which the locking bar is engaged in a respective through hole formed through the edges of the first and second articulated half-shells of the suitcase.

Due to the unavoidable coupling clearance provided between the locking bar and the hole through the edges of the suitcase, the padlock can move accidentally, for example rotate about the locking bar, during ordinary use, handling and transfer of the suitcase.

This phenomenon is absolutely unpleasant and unwelcome, since it can cause damage to the surface of the suitcase or to other items, and can also constitute a potential danger for the user, since the padlock constitutes, in this situation, a blunt object that can cause injuries.

SUMMARY OF THE INVENTION

The aim of the present invention is to obviate the above-mentioned drawback, by providing a lock for suitcases, trunks and the like in which the padlock is prevented from performing accidental movements and is therefore suitable to prevent potential damage to objects or people.

Within this aim, an object of the present invention is to provide a lock that is substantially universal, i.e., adaptable to any suitcase or trunk of the type constituted by two mutually articulated half-shells.

Another object of the present invention is to provide a lock that is simple, relatively easy to provide in practice, safe in use, effective in operation, and has a relatively low cost.

This aim and this and other objects that will become better apparent hereinafter are achieved by the present lock for suitcases, trunks and the like, of the type constituted by a first half-shell and a second half-shell which are mutually articulated, comprising at least one padlock in which a locking bar is engaged, in a closed configuration, in a first through hole and in a second through hole, which are coaxial and are provided respectively in the first edge and in the second edge of said first half-shell and said second half-shell, characterized in that said padlock forms surfaces for mating with said first edge and with said second edge so that in a closed configuration said padlock is retained in a preset safe position that provides minimum protrusion.

BRIEF DESCRIPTION OF THE DRAWINGS

Further characteristics and advantages of the present invention will become better apparent from the following detailed description of a preferred but not exclusive embodiment of a padlock-type lock for suitcases, trunks and the like according to the invention, illustrated by way of non-limiting example in the accompanying drawings, wherein:

FIG. 2 is a detail perspective view of the lock, with the padlock disengaged from the edges of the half-shells of the suitcase;

FIG. 3 is another perspective view of the padlock of the lock according to the invention;

FIG. 4 is a plan view of the padlock.

DESCRIPTION OF THE PREFERRED EMBODIMENTS

Figure 1:
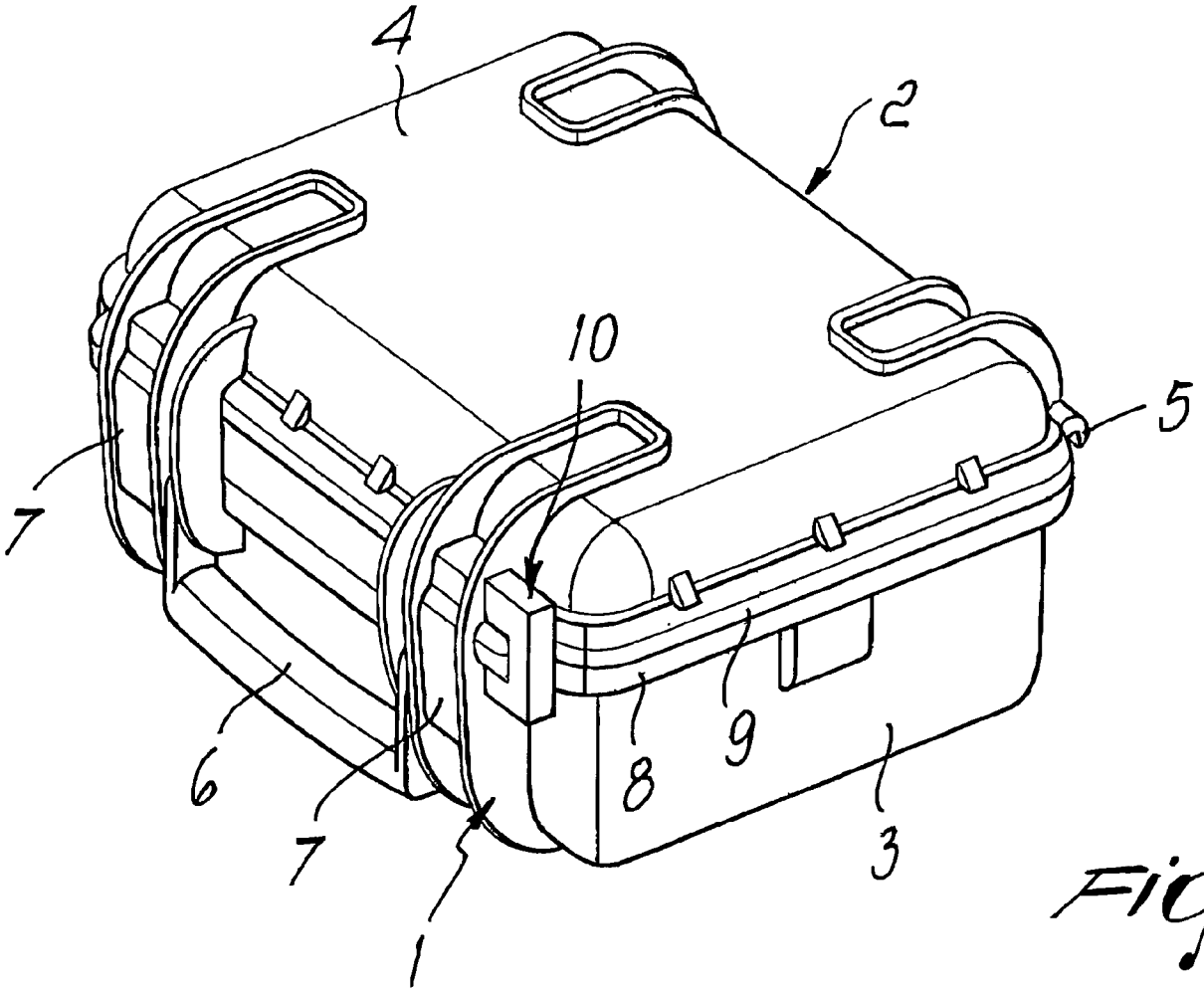
FIG. 1 is a perspective view of a suitcase closed with a lock according to the invention.

In the embodiments that follow, individual characteristics, may actually be interchanged with other different characteristics that exist in other embodiments.

Moreover, it is noted that anything found to be already known during the patenting process is understood not to be claimed and to be the subject of a disclaimer.

With reference to FIG. 1, the reference numeral 1 generally designates a lock for suitcases, trunks and the like according to the invention: the lock 1 is installed, in the specific embodiment described hereinafter, on a tool-carrying case, generally designated by the reference numeral 2, particularly for professional uses. However, it is noted that the lock according to the invention is extremely versatile and adaptable to any kind of suitcase or trunk of any size and for any use.

The case 2, shown in FIG. 1, is of the type constituted by a first half-shell 3 and by a second half-shell 4, which are mutually articulated at hinges 5, and is provided with at least one grip handle 6. Two locking elements 7 are provided at the sides of the handle, are hinged to one of the half-shells 3 and 4 and are suitable to keep said half-shells in contact with each other when the suitcase is closed. The first half-shell 3 and the second half-shell 4 form respectively a first perimetric edge 8 and a second perimetric edge 9, which are in mutual contact when the suitcase is in the closed configuration.

The lock is constituted by a padlock 10, for example of the type that can be operated by means of a key or by means of a device with a numeric combination, provided with a cylindrical locking bar 11 that is suitable to be inserted in a first through hole 12 formed in the first edge 8 and in a second through hole 13 formed in the second edge 9, such holes being mutually coaxial (FIG. 2).

The padlock 10 is preferably of the type that has a substantially U-shape casing, which forms a first end portion 14, affected by a through channel 15 along which the bar 11 is engaged so that it can slide, and a second end portion 16, in which there is a receptacle 17 provided with means for selectively locking the end of the bar 11, which can be operated for example with a key in an appropriately provided lock 18, or alternatively by way of a device with a numeric combination.

According to the invention, the first end portion 14 and the second end portion 16 of the padlock 10 form respectively a first surface 19 and a second surface 20 for mating with the first edge 8 and the second edge 9 (FIG. 3), so that when the suitcase is closed the padlock 10 is retained stably in a preset safe and minimum-protrusion position, shown in FIG. 1; in this position, the padlock 10 cannot perform accidental movements, caused by the displacement of the suitcase during its use, which might damage the surface of the suitcase, other objects or even people.

Advantageously, the first mating surface 19 is flat and inclined, by a preset angle $\alpha$, with respect to a plane that is perpendicular to the axis of the bar 11 (FIG. 4). The first edge 8 has, at the first hole 12, a profile that is inclined by the same first angle $\alpha$ with respect to the ideal plane traced by the perimeter of the first edge 8.

The second surface 20 is likewise flat and inclined, with respect to the axis of the bar 11, by a second preset angle $\beta$ (FIG. 4); at the second hole 13, the second edge 9 forms a profile that is inclined by the same second angle $\beta$ with respect to the ideal plane traced by the perimeter of the second edge 9. In this manner, the first and second edges 8, 9 arranged mutually adjacent, when the suitcase is in the closed configuration, form a sort of wedge, which mates with the first surface 19 and with the second surface 20, so as to prevent accidental movements or rotations of the padlock 10 from the safe and minimum-protrusion position in which it is locked.

The first preset angle α and the second preset angle β preferably have the same value, which in the specific embodiment shown in the figures is 18° and is given here merely as a non-limiting example.

It has thus been shown that the invention achieves the intended aim and objects. The described lock ensures that the locking padlock 10 is retained stably in a safe and minimum-protrusion position, from which it cannot move accidentally, causing damage to said suitcase, to other objects and to people.

The invention thus conceived is susceptible of numerous modifications and variations, all of which are within the scope of the inventive concept.

All the details may further be replaced with other technically equivalent ones.

In practice, the materials used, as well as the shapes and the dimensions, may be any according to requirements without thereby abandoning the scope of the protection of the appended claims.

The disclosures in Italian Utility Model Patent Application No. BO2004U000005 from which this application claims priority are incorporated herein by reference.

What is claimed is:

1. A case and a padlock-type lock, the case being constituted by a first half-shell and a second half-shell which are mutually articulated, said first half-shell being provided wit a first perimetric edge that has a first edge profiled surface inclined at a first angle with respect to an ideal laying plane of the first perimetric edge, said first perimetric edge comprising at least one first through hole therein, and said second half-shell being provided with a second perimetric edge that has a second edge profiled surface inclined at a second angle with respect to an ideal laying plane of the second perimetric edge, said second perimetric edge comprising at least one second through hole therein, said first and second perimetric edges being shaped so as to be in mutual contact in a closed configuration of the case in which said first and second inclined edge profiled surfaces are located in a corresponding arrangement forming a wedge and in which said at least one first and second trough holes are arranged coaxial and aligned with each other; the padlock-type lock being constituted by at least one padlock, said at least one padlock comprising a locking bar and first and second opposite, mating surfaces; and wherein said mating surfaces are shaped flat arid correspondingly inclined to mate over said wedge, in the closed configuration of the case, with said first and with said second edge profiled surfaces, respectively, and said locking bar is adapted to engage in said first and second through holes so that said at least one padlock is retained in a preset safe and minimum-protrusion position.

2. The case and padlock-type lock of claim 1, wherein said at least one padlock has a casing that is substantially U-shaped and forms a first end portion, which is provided with a through channel in which said locking bar is engaged in a slidable manner, and a second end portion, which is provided with a receptacle, said receptacle comprising locking means for selective locking of an end of said locking bar, and wherein said first mating surface is provided on said first end portion and the second mating surface is provided on said second end portion.

3. The case and padlock-type lock of claim 2, wherein said first mating surface is arranged at a first preset angle with respect to a plane that is perpendicular to an axis of said locking bar, said first perimetric edge having, at said first through hole, said first edge profiled surface that is inclined by said first angle with respect to an ideal laying plane of said first perimetric edge.

4. The case and padlock-type lock of claim 3, wherein said second mating surface is arranged at a second preset angle with respect to a plane that is perpendicular to the axis of said locking bar, said second perimetric edge having, at said second through hole, the second edge profiled surface profile that is inclined by said second angle with respect to an ideal laying plane of said second perimetric edge.

5. The case and a padlock-type lock of claim 4, wherein said first preset angle and said second preset angle are identical.

6. The case and padlock-type lock of claim 1, wherein the case is a any of a suitcase, a trunk or a tool-carrying vase.

7. A case and a padlock-type lock, the case being constituted by a first half-shell and a second half-shell which are mutually articulated, said first half-shell being provided wit a first perimetric edge that has a first edge profiled surface inclined at a first preset angle with respect to an ideal laying plane of die first perimetric edge, said first perimetric edge comprising at least one first through hole therein, and said second half-shell being provided with a second perimetric edge that has a second edge profiled surface inclined at a second preset angle with respect to an ideal laying plane of the second perimetric edge, said second perimetric edge comprising at least one second through hole therein, said first and second perimetric edges being shaped so as to be in mutual contacting a closed configuration of the case in which said first and second inclined edge profiled surfaces are located in a corresponding arrangement and form a wedge and in which said at least one first and second through holes are arranged coaxial and aligned with each other; the padlock-type lock being constituted by at least one padlock, said at least one padlock comprising a locking bar and first and second opposite mating surfaces that are each flat and inclined with respect to a plane perpendicular to a longitudinal axis of said locking bar by a preset angle that corresponds to said first and, respectively, to said second preset inclination angle of said first and second edge profiled surfaces, and wherein, in said closed configuration of the case, said mating surfaces mate ova said wedge with said first and with said second edge profiled surfaces, respectively, and said locking bar engages in said first and second trough holes so that said at least one padlock is retained in a preset safe and minimum-protrusion position.

8. The case and padlock-type lock of claim 7, wherein said at least one padlock has a casing that is substantially U-shaped and forms a first end portion, which is provided with a through channel in which said locking bar is engaged in a slidable manner, and a second end portion, which is provided with a receptacle, said receptacle comprising locking means for selective locking of an end of said locking bar, and wherein said first mating surface is provided on said first end portion and the second mating surface is provided on said second end portion.

9. The case and padlock-type lock of claim 7, wherein the case is a any of a suitcase, a trunk or a tool-carrying case.

* * * * *